US010018400B2

(12) United States Patent
Qu et al.

(10) Patent No.: US 10,018,400 B2
(45) Date of Patent: Jul. 10, 2018

(54) DEFROST OPERATION MANAGEMENT IN HEAT PUMPS

(71) Applicant: Lennox Industries Inc., Richardson, TX (US)

(72) Inventors: Yi Qu, Coppell, TX (US); Bruce Perkins, Carrollton, TX (US); Mark Olsen, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 1367 days.

(21) Appl. No.: 13/965,543

(22) Filed: Aug. 13, 2013

(65) Prior Publication Data

US 2015/0047375 A1 Feb. 19, 2015

(51) Int. Cl.

| | |
|---|---|
| ***F25B 47/02*** | (2006.01) |
| ***F25D 21/00*** | (2006.01) |
| ***F24F 11/41*** | (2018.01) |
| ***F24F 11/42*** | (2018.01) |
| ***F24F 11/43*** | (2018.01) |
| ***F25B 30/02*** | (2006.01) |

(52) U.S. Cl.

CPC ..... *F25D 21/004* (2013.01); *F24F 11/41* (2018.01); *F24F 11/42* (2018.01); *F24F 11/43* (2018.01); *F25B 30/02* (2013.01); *F25B 47/022* (2013.01); *F25B 47/025* (2013.01); *F25D 21/008* (2013.01); *F25B 2600/01* (2013.01); *F25B 2700/11* (2013.01)

(58) Field of Classification Search

CPC ..... F24F 2011/0087; F24F 2011/0089; F24F 2011/009; F24F 11/41; F24F 11/42; F24F 11/43; F25B 47/02; F25B 47/022; F25B 47/025; F25B 2700/11; F25D 21/008

USPC ..... 62/155

See application file for complete search history.

(56) References Cited

U.S. PATENT DOCUMENTS

| | | | | |
|---|---|---|---|---|
| 5,524,449 | A * | 6/1996 | Ueno | F25B 13/00 62/234 |
| 6,378,315 | B1 * | 4/2002 | Gelber | F25D 29/00 236/51 |
| 7,000,422 | B2 * | 2/2006 | Street | G05D 23/00 236/51 |
| 2007/0180838 | A1 * | 8/2007 | Shah | F25D 21/008 62/150 |
| 2012/0180505 | A1 * | 7/2012 | Gerber | F24D 5/12 62/82 |
| 2013/0160471 | A1 * | 6/2013 | Worley | F25D 21/06 62/81 |

* cited by examiner

*Primary Examiner* — Frantz Jules
*Assistant Examiner* — Erik Mendoza-Wilkenfe
(74) *Attorney, Agent, or Firm* — Baker Botts L.L.P.

(57) ABSTRACT

In various implementations, a heat pump may include heating operations and defrost operations. The heat pump may monitor cycle time(s) for one or more of the operations. Defrost operation(s) in the heat pump may be automatically adjusted based at least partially on cycle times.

18 Claims, 2 Drawing Sheets

DEFROST OPERATION MANAGEMENT IN HEAT PUMPS

TECHNICAL FIELD

The present disclosure relates to defrost operations in heat pumps.

BACKGROUND

Heat pumps may be utilized in residential air conditioning, commercial air conditioning, and/or refrigeration. During operation, a heat exchanger of the heat pump may be exposed to cold conditions in which frost may accumulate on surfaces of the heat pump. Frost on surfaces of the heat pump may inhibit normal operations of the heat pump and/or cause mechanical failure of the heat pump and/or portions thereof.

SUMMARY

In various implementations, one or more operations of a heat pump may be allowed, wherein the heat pump includes a heating operation and one or more defrost operations. A heating operation cycle time may be determined and compared to a predetermined heating operation cycle time. Adjustment of at least one property of at least one of the defrost operations may be allowed if the determined heating operation cycle time is less than the predetermined heating operation cycle time, and adjustment of at least one property of at least one of the defrost operations may be inhibited if the determined heating operation cycle time is not less than the predetermined heating operation cycle time. The predetermined heating operation cycle time may be at least one of approximately 45 minutes or approximately 50 minutes.

Implementations may include one or more of the following features. A request may be received for operation of a heat pump, and a determination may be made whether the determined heating operation cycle time is greater than a second predetermined heating operation cycle time. Operation of the heat pump may be allowed based at least partially on the request for operation if the determined heating operation cycle time is greater than the second predetermined heating operation cycle time. A request for operation of a heat pump may be received, and a determination may be made whether the determined heating operation cycle time is greater than a second predetermined heating operation cycle time. Further adjustment may be made of at least one of the adjusted properties of an adjusted defrost operation to a default property associated with the adjusted property if the determined heating operation cycle time is greater than the second predetermined heating operation cycle time. Adjustment of at least one of the properties of the defrost operations may be allowed, and a determination of a second heating operation cycle time may be made. A determination may be made if the second heating operation cycle time is less than the predetermined heating operation cycle time. The adjusted defrost operation may be allowed if the second heating operation cycle time is not less than the predetermined heating operation cycle time, and an additional adjustment of at least one of the properties of at least one of the defrost operations may be allowed if the second heating operation cycle time is not less than the predetermined heating operation cycle time. One or more of the defrost operations may include at least one of a primary defrost operation or a secondary defrost operation. At least one of the properties allowed to be adjusted may include a termination property of the defrost operation. Adjustment of at least one of a termination temperature or a termination time may be allowed when adjusting at least one property of at least one of the defrost operations, and adjustment of one or more other properties of the defrost operation may be restricted.

In various implementations, one or more operations of a heat pump may be allowed, wherein the heat pump includes a heating operation and one or more defrost operations. A determination may be made of at least one cycle time associated with at least one of the operations of the heat pump. A determination may be made whether to adjust at least one property of at least one of the defrost operations based at least partially on one or more of the determined cycle times. At least one defrost operation may be allowed.

Implementations may include one or more of the following features. At least one of the cycle times may include a heating operation cycle time. At least one of the properties of at least one of the defrost operations may include at least one of a termination time or a termination temperature. At least one of the properties of at least one of the defrost operations may include a termination temperature, and the termination temperature may include a default termination temperature. A user request may be received for alteration of a termination temperature, and the termination temperature may be altered based on the received user request. Allowing a defrost operation may include allowing an unaltered defrost operation when a determination is made to not allow an adjustment of at least one property of at least one of the defrost operations. Allowing a defrost operation may include allowing an altered defrost operation when a determination is made to allow an adjustment of at least one property of at least one of the defrost operations. A determination whether to adjust at least one property of at least one of the defrost operations based at least partially on one or more of the determined cycle times may include comparing at least one of the determined cycle times to a predetermined cycle time, and allowing adjustment of at least one property of at least one of the defrost operations based on the comparison. A determination whether to adjust at least one property of at least one of the defrost operations based at least partially on one or more of the determined cycle times may include comparing at least one of the determined cycle times to a predetermined cycle time, and allowing adjustment of at least one property of at least one of the defrost operations when at least one of the determined cycle times is less than a predetermined cycle time. Adjustment of at least one property of at least one of the defrost operations may include increasing at least one of a termination temperature or a termination time.

In various implementations, a heat pump may allow defrost operations to reduce and/or inhibit accumulation of an amount of ice on the heat pump or portions thereof. The properties of the defrost operations may be automatically altered based on a heating operation cycle time of the heat pump. The heat pump may include one or more components, including at least two heat exchangers, and one or more operation modules. One or more operations of the heat pump may be allowed, wherein at least two of the operations may include a heating operation and at least one defrost operation. A determination may be made whether to allow a defrost operation. A cycle time may be determined, and a determination may be made whether to adjust at least one of the defrost operations based at least partially on the determined cycle time. At least one defrost operation may be allowed.

Implementations may include one or more of the following features. The cycle time may include a heating operation cycle time. Adjustment of at least one of the defrost operations may include adjusting a termination property of a defrost operation. One or more of the components may include one or more fans. At least one of the fans may have a low speed and at least one higher speed. At least two of the operations modules may include a primary defrost operation module and a secondary defrost operation module. The primary defrost operation module may restrict operation of at least one of the fans and allow a cooling cycle of the heat pump. The primary defrost operation module may at least partially reduce an accumulation of frost proximate at least a portion of the heat pump. The secondary defrost operation module may allow operation of at least one of the fans during the cooling cycle of the heat pump. The secondary defrost operation module may at least partially reduce an accumulation of frost proximate at least a part of the heat pump.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Heat pumps may be utilized in a variety of applications, such as air conditioning and refrigeration systems. During operation, some portions of the heat pump, such as fan(s), housing(s), and heat exchanger(s) may be subject to conditions that cause an ice event (e.g., ice and/or frost accumulation). Frost/ice accumulation may cause noise during operation, cause wear on portions of the heat pump, and/or inhibit operation of at least a portion of the heat pump (e.g., ice accumulation may restrict fan blade movement). A heat pump may include defrost operations to inhibit ice events and/or reduce the amount of ice that forms on the heat pump. In various implementations, defrost operations of a heat pump may be managed.

Figure 1:
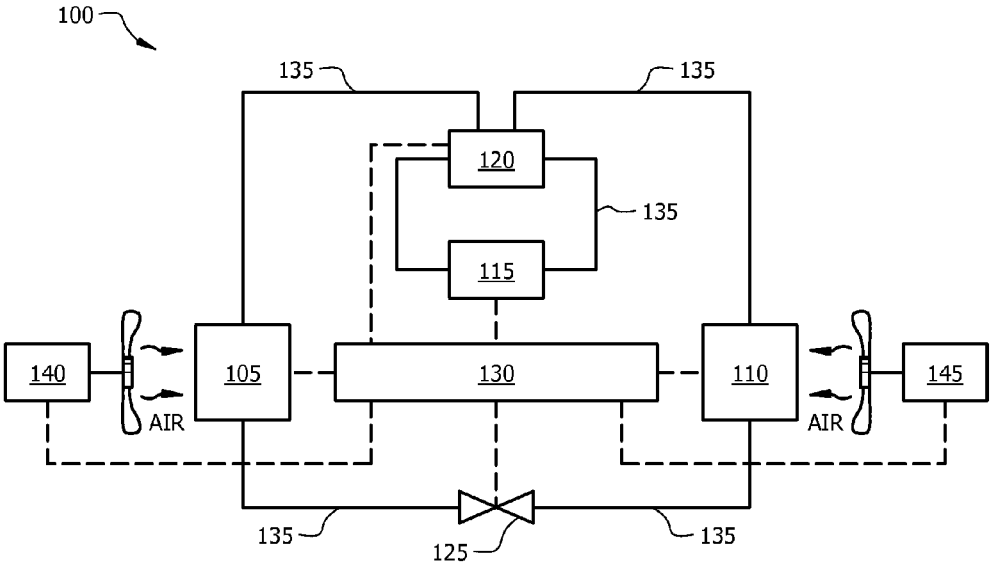
FIG. 1 illustrates an implementation of an example heat pump.

FIG. 1 illustrates an implementation of an example heat pump 100. As illustrated, the heat pump 100 includes heat exchangers 105, 110, compressor 115, reversing valve 120 (e.g., a valve capable of changing the direction of flow of refrigerant through one or more of the components), and/or an expansion valve 125.

A controller 130 (e.g., a computer) may be coupled (e.g., communicably, such as by wires or linked by WiFi) to component(s) of the heat pump 100 and control various operations of the component(s) and/or system. For example, the controller 130 may include a management module, stored in a memory of the controller and executable by a processor of the controller, to perform various operations of the heat pump 100. The management module may control operations of the heat pump, such as receiving requests for operation, determining whether to respond to requests for operation, responding to requests for operation, operating various components (e.g., compressors, reversing valves, and/or expansion valves), determining whether to allow a cooling operation (e.g., reduce the temperature of air provided to a location), a heating operation (e.g., increase the temperature of air provided to a location), and/or a defrost operation (e.g., to inhibit and/or reduce ice formation on portions of the heat pump, such as the fan and/or housing), determine which defrost operation to allow, determine termination conditions (e.g., temperatures and/or times) for operations of the heat pump, determine appropriate alterations of defrost operations, etc.

Lines 135 (e.g., tubing) may couple various components and allow refrigerant to flow in and/or out of various components of the heat pump 100. Fans 140, 145 may cause air to flow through heat exchangers 105, 110 disposed proximate the fans.

In some implementations, a portion of the heat pump 100 may be disposed outside a building (e.g., an "outdoor portion" on the ground proximate a building and/or on a roof of the building) and a portion of the heat pump may be disposed inside the building (e.g., an "indoor portion"). For example, the outdoor portion may include heat exchanger 105 and fan 140 and the indoor portion may include heat exchanger 110 and fan 145. The outdoor and/or indoor portion may be at least partially disposed in housing(s).

A heat pump 100 may allow operations with heating and cooling cycles. During a cooling cycle, cool air may be provided by blowing air (e.g., from a fan 145) at least partially through a first heat exchanger 110 (e.g., indoor portion), which acts as an evaporator to evaporate liquid refrigerant. A temperature of the air may be reduced and the cool air may be provided to a location (e.g., via ducting). The gaseous refrigerant may exit the first heat exchanger 110, be compressed by a compressor 115, and delivered to a second heat exchanger 105 (e.g., outdoor portion), which acts as a condenser. The second heat exchanger 105 may condense the gaseous refrigerant, for example, by blowing air (e.g., from a fan 140) at least partially through the second heat exchanger 105 to remove heat from the gaseous refrigerant.

To operate the heat pump 100 in a heat cycle, the heat pump 100 may include a reversing valve 120 to change the direction of refrigerant flow allow such that the refrigerant flows in the opposite direction as the refrigerant flow in the cooling cycle. For example, hot air may be provided by a fan 145 blowing air across the first heat exchanger 110 (e.g., indoor portion), which acts as a condenser (e.g., the air may remove heat from the refrigerant and allow the refrigerant to condense). The hot air may be provided (e.g., via ducting) to a location by the heating system. The second heat exchanger 105 (e.g., outdoor portion) may act as an evaporator and the temperature of the air, provided by fan 140, may be cooler leaving the second heat exchanger 105 than when entering the second heat exchanger 105.

During use, when a heat pump 100 may be exposed to cold and moist air, and frost (e.g., frost and/or ice) may accumulate on surfaces and/or other portions of component(s) of the heat pump 100. Since the second heat exchanger operates as an evaporator during a heating operation, moisture from the air may condense on the second heat exchanger coils. When the ambient air is cold, the moisture drawn from the air may freeze and accumulate as ice on surfaces of the heat exchanger and/or fan. For example, when the second heat exchanger 105 and/or fan 140 are subject to moist and/or cold air, frost may accumulate on surfaces of the fan housing, fan blade, fan orifice, heat exchanger housing, and/or heat exchanger coil (e.g., coil tubing and/or fins). The frost accumulation may cause noise during operation, wear on portions of the heat pump, and/or inhibit operation of at least a portion of the heat pump (e.g., the fan blade may be inhibited from rotating due to ice accumulation between the fan blade and the fan orifice). Noisy operation of a heat pump may decrease user satisfaction of a heat pump.

In some implementations, a heat pump may include one or more defrost operations. A heat pump (e.g., an operation module) may determine which defrost operation(s) to allow, how many defrost operation(s) to allow, an order in which defrost operation(s) are allowed (e.g., order, sequence, and/or timing), and/or operating parameters (e.g., termination properties) of the defrost operation. Defrost operations may include allowing a cooling operation, restricting one or more portions of the heat pump from operating, allowing one or more portions of the heat pump to operate, and/or other appropriate operations to generate heat to reduce and/or inhibit ice accumulation.

In some implementation, to reduce and/or inhibit the ice accumulation (e.g., frost and/or ice) in the heat pump, modules of the controller may allow primary and/or secondary defrost operations. For example, U.S. patent application Ser. No. 13/690,645 to Qu et al. entitled "Secondary Defrost for Heat Pumps" and filed on Nov. 30, 2012, describes various defrost operations that may be utilized in conjunction with the various described systems and processes, as appropriate. In some implementations, a defrost operation may include allowing a cooling cycle for a predetermined termination time (e.g., until a termination time) and/or until a temperature of a portion of the heat pump (e.g., a coil of a heat exchanger and/or a portion of the housing) is approximately the same as a predetermined termination temperature. A defrost operation may include allowing a cooling operation with a fan proximate the affected heat exchanger (e.g., an outside heat exchanger with ice accumulation) on a low speed or inhibited from operating.

Defrost operations may include properties such as termination temperature (e.g., measured proximate a portion of the heat pump, such as an outdoor coil, housing, and/or fan), termination time, and/or termination based on a predetermined value for a change in temperature over time. When defrost operations are allowed, they may inhibit and/or reduce some of the ice accumulation; however, each time the defrost operation is allowed, user satisfaction may be temporarily decreased (e.g., since cool air may blow into a location during a defrost operation) and/or operation costs may be increased (e.g., since the temperature at a location may be reduced due to cool air introduction, and then following heating operation may have to raise the temperature of the location which has been cooled below a setpoint temperature provided, for example, in a user request). In some implementations, the frequency (e.g., the number of operations allowed in a predetermined period) of defrost operations may need to be increased to reduce and/or inhibit ice accumulation and as the frequency of defrost operations increase, user satisfaction may decrease and/or operation costs may increase (e.g., since the heating operation may compensate for temperature reduction due to the defrost operation to satisfy user requests for heating operations).

Thus, adjustment of properties of the defrost operations may be allowed to, for example, increase user satisfaction, decrease costs, and/or improve performance (e.g., by allowing greater control over when and/or how defrost operations are allowed). For example, a heat pump (e.g., an operation module of a heat pump) may automatically adjust one or more defrost operations allowed by the heat pump based on an operation factor, such as cycle time (e.g., heating operation cycle time, time between defrost cycles, number of type of cycle in a predetermined period, and/or number of cycles in a predetermined period). In some implementations, by incrementally increasing and/or decreasing values for a property of the operation, such as termination properties (e.g., time and/or temperature), greater control of an operation of a heat pump may be allowed.

For example, while during freezing rain a maximum defrost cycle (e.g., defrost cycle at a maximum termination property, such as maximum coil temperature) may be allowed to achieve a greater reduction in ice accumulation, when other cool moist conditions are present, it may be more cost efficient and/or increase user satisfaction to allow a defrost operation to be incrementally increased (e.g., up to a maximum termination property). Thus, in some implementations, ice accumulation may be reduced and/or inhibited by altering a defrost cycle by adjusting a property of the defrost cycle incrementally based on a cycle time as opposed to operating the defrost cycle only at a maximum termination property (e.g., maximum coil temperature that does not cause mechanical failure and/or maximum coil temperature that a user will tolerate).

Figure 2:
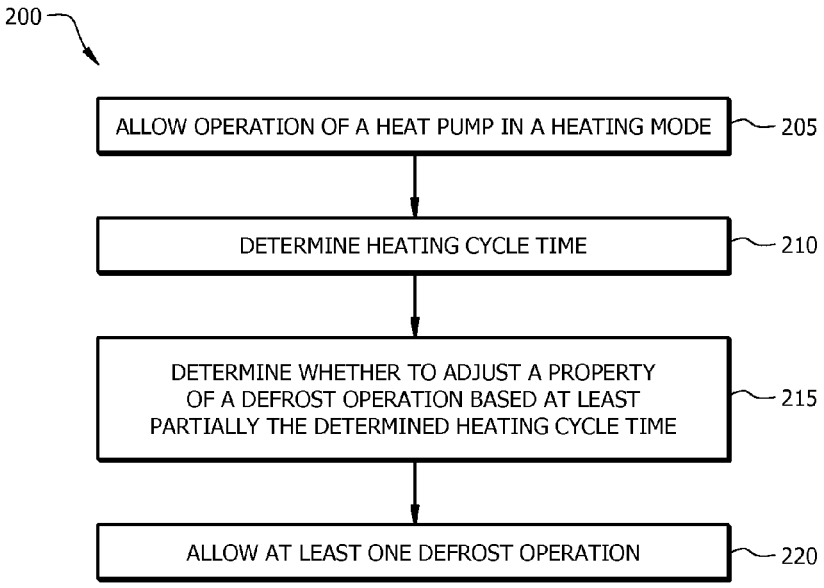
FIG. 2 illustrates an implementation of an example process for allowing defrost operations in an example heat pump.

FIG. 2 illustrates an implementation of an example process 200 for managing defrost operations of a heat pump, such as the example heat pump illustrated in FIG. 1. As illustrated, an operation of a heat pump in a heating mode may be allowed (operation 205). A heating mode may allow hot air to be generated (e.g., by elevating the temperature of air blown across a heat exchanger) and delivered to a location. The heating mode may be initiated when a module of a controller delivers a signal to the reversing valve to allow a heating mode. The heating mode may be operated until a setpoint parameter, such as temperature, provided in a user request for operation, is satisfied and/or until a determination is made to allow a defrost operation (e.g., in response to detecting ice on various components of the heat pump, implementations of which are described in U.S. patent application Ser. No. 13/690,645, and/or in response to a comparison of measured properties to predetermined properties).

A heating operation cycle time may be determined (operation 210). The heating mode may be allowed to operate for a time period (e.g., until a request for a defrost operation is received, until a determination by the controller to allow a defrost operation is made, until a setpoint temperature is achieved by the heating operation, until a setpoint parameter is satisfied, and/or until a user requests restricting of a heating operation cycle). The time period of operation may be determined. In some implementations, the heating operation cycle may be the period of time between two defrost operations.

Since ice may accumulate during a heating operation cycle and/or other operations (e.g., a rest operation in which heating, cooling, and/or defrost operations may be restricted and/or other operations) on heat exchangers, fans, and/or portions thereof, one or more defrost operations may be allowed. The defrost operation may reduce and/or inhibit ice accumulation on the heat pump or portions thereof. A determination may be made whether to adjust a property of a defrost operation based at least partially on the determined heating operation cycle time (operation 215). For example, the heating operation cycle time may be compared to a predetermined heating operation cycle time, a previous heating operation cycle time, etc. The determination of whether to adjust the property of defrost operation(s) may be based at least partially on the comparison. For example, a property such as a termination property, which may include termination time (e.g., time at which the defrost operation may be ended) and/or termination temperature (e.g., temperature at which the defrost operation may be ended), may be adjusted for one or more defrost operation.

At least one defrost operation may be allowed (operation 220). In some implementations, after a determination of whether to allow a defrost operation is made, one or more defrost operations (e.g., adjusted and/or unadjusted) may be allowed. For example, a defrost operation may include an operation module transmitting a signal to the reversing valve to reverse the flow of refrigerant, and thus allow a cooling cycle (e.g., since the cooling cycle may generate heat proximate areas of ice accumulation and/or potential ice accumulation). In some implementations, more than one defrost operation may be allowed. For example, a primary defrost operation (e.g., allowing a cooling cycle and/or restricting fan operation) and a secondary defrost operation (e.g., allowing a fan to operate at a low speed) may be allowed. The defrost operations may be allowed concurrently and/or approximately consecutively. In some implementations, an altered defrost operation and a unaltered defrost operation may be allowed.

Process 200 may be implemented by various systems, such as system 100. In addition, various operations may be added, deleted, and/or modified. For example, although a heating operation cycle time is determined in the described process 200, other properties related to cycle times of the various operations may be utilized to determine whether to adjust one or more properties of defrost operation(s). In some implementations, a time between defrost operations may be measured. The determination of whether to adjust a property of a heating operation cycle may be based at least partially on the determined time between defrost operations. In some implementations, the measured time between defrost operations may be utilized to determine a heating operation cycle time. In some implementations, a number of occurrences of a type of operation (e.g., heating, cooling, and/or defrost) that occur during a predetermined period of time or a operation frequency may be determined. The operation frequency may be utilized to determine a heating operation cycle time and/or a determination of whether to adjust a property of a defrost operation may be determined based at least partially on the operation frequency.

Figure 3:
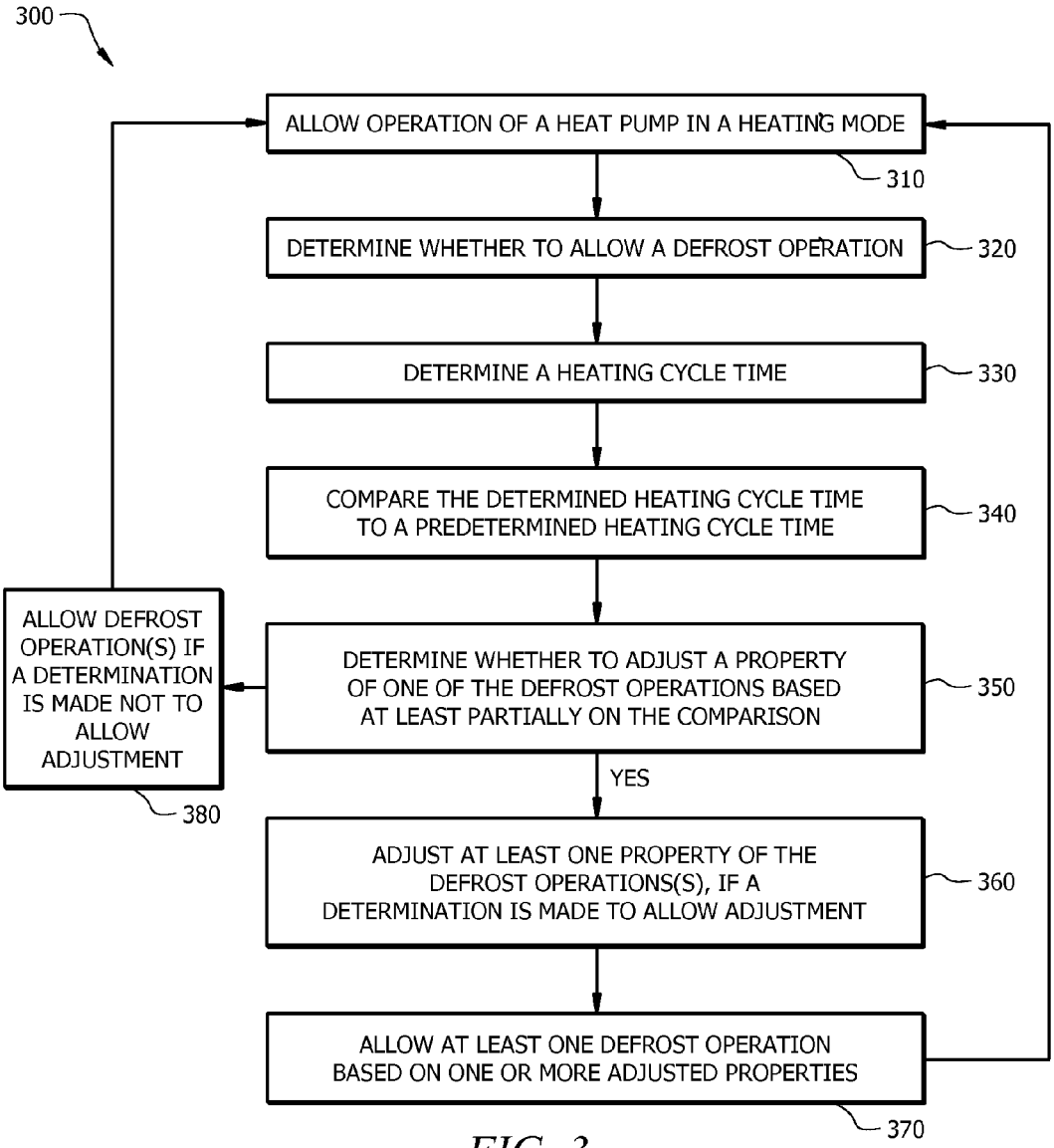
FIG. 3 illustrates an implementation of an example process for allowing defrost operations in an example heat pump.

FIG. 3 illustrates an implementation of an example process 300 for management of default operations of a heat pump. An operation of a heat pump in a heating mode may be allowed (operation 310). For example, a user may request operation of a heat pump to provide hot air to a location. An operation module of the heat pump may receive the signal and transmit a signal to the reversing valve to allow a heating operation. The operation module may determine and/or manage the operating parameters of the heating operation. As the heating operation of the heat pump is allowed, the heat exchanger, that is outdoors, for example, may be exposed to cool, moist air and ice may accumulate on the heat exchanger, fan proximate the heat exchanger, and/or portions thereof.

A determination may be made whether to allow a defrost operation (operation 320). A controller (e.g., operation module) may determine whether to allow a defrost operation. For example, a defrost operation may be allowed after a predetermined amount of time during heating operations. In some implementations, a first property may be monitored and compared to a predetermined value to determine whether to allow a defrost operation. For example, properties, such as temperature, humidity, pressure, and/or wind velocity may be monitored and a determination may be made whether an ice event has occurred based on the monitored properties (e.g., the monitored properties may be compared to predetermined values associated with an ice event). When an ice event has been determined to have occurred, then a determination may be made to allow a defrost operation.

A heating operation cycle time may be determined (operation 330). For example, a time between the commencements of heating operations may be measured. In some implementations, a time between when signals to allow heating operations are transmitted to the reversing valve may be measured to determine a heating operation cycle time.

The determined heating operation cycle time may be compared to a predetermined heating operation cycle time (operation 340). For example, the predetermined heating operation cycle time may be stored in a memory of the heat pump. The operation module may retrieve the predetermined heating operation cycle time (e.g., 45 minutes, 50 minutes, and/or from approximately 40 minutes to approximately 55 minutes) and compare the predetermined heating operation cycle time to the determined heating operation cycle time. For example, a predetermined heating operation cycle may be a previous heating operation cycle time (e.g., last heating operation cycle time and/or average of one or more previous heating operation cycle times). Thus, in some implementations the determined heating operation cycle time may be compared to a previous heating operation cycle time to determine if heating operation cycles durations are increasing (e.g., which may indicate that defrost operations are managing the ice accumulation effectively) or decreasing (e.g., which may indicate that defrost operations need to be altered to obtain better control of ice accumulation, when compared to current operating defrost operation results).

A determination may be made whether to adjust a property of one of the defrost operations based at least partially on the comparison (operation 350). For example, when the determined heating operation cycle is less than approximately 45 minutes (e.g., in 2 ton heat pumps), then a determination may be made to allow adjustment of a property of a defrost operation. In some implementations, when the determined heating operation cycle is less than approximately 50 minutes, a determination may be made to allow adjustment of a property of a defrost operation. In some implementations, the predetermined heating operation cycle time may include a range of times, such as from approximately 43 minutes to approximately 47 minutes or approximately 48 minutes to approximately 50 minutes.

At least one property of the defrost operation(s) may be adjusted, if a determination is made to allow adjustment (operation 360). For example, a termination temperature for a defrost operation may be adjusted. The termination temperature may be a temperature at which the defrost operation is restricted (e.g., the heating operation is allowed and the defrost operation is restricted). For example, a termination temperature for a defrost operation may be increased. When the initial and/or previous termination temperature is approximately 50 degrees Fahrenheit, then the adjustment to the termination temperature may be increasing the termination temperature to 90 degrees Fahrenheit. In some implementations, the termination temperature may be increased by a predetermined increment (e.g., approximately 10 degrees Fahrenheit, approximately 20 degrees Fahrenheit, approximately 5 minutes, approximately 10 minutes and/or other appropriate amount), when the termination property is adjusted. In some implementations, the termination temperature may be increased to a predetermined maximum termination temperature (e.g., based on default values, based on field technician provided values, and/or based on user supplied values). The maximum termination temperature may be a temperature above which mechanical failure (e.g., wear on components and/or pre-failure events) may occur and/or based on user satisfaction properties (e.g., a user may be dissatisfied if a defrost operation is allowed for 30 minutes), in some implementations.

At least one defrost operation based on one or more of the adjusted properties may be allowed, if the defrost operation is adjusted (operation 370). A property of the defrost operation may be adjusted and the defrost operation may be allowed to operation based on the adjustment. For example, a defrost operation may include allowing a cooling operation. The cooling operation may be allowed until a termination temperature is reached at an outdoor coil (e.g., a heat exchanger in an outdoor portion). The operation module may have increased and/or decreased the termination temperature as an adjustment based on the heating operation cycle time.

Defrost operation(s) may be allowed if a determination is made not to allow adjustment (operation 380). In some implementations, the unadjusted defrost operation may be allowed, such as a cooling operation until an unadjusted termination temperature is reached at an outdoor coil (e.g., a maximum termination temperature, a default termination property, and/or a field technician provided termination property).

Process 300 may be implemented by various systems, such as system 100. In addition, various operations may be added, deleted, and/or modified. In some implementations, process 300 may be performed in combination with other processes such as process 200. For example, an adjustment of the defrost operation may include an adjustment to a property of the defrost operation. In some implementations, the property of a defrost operation may include a termination property such as temperature and/or time. The adjustment to the termination property may include an adjustment from a default and/or field technician provided value and/or an adjustment to the termination property utilized in a previous defrost operation.

In some implementations, the operation module may be allowed to adjust one or more properties of a defrost operation and may be restricted from adjusting one or more other properties of a defrost operation based on operating parameters stored in the controller. For example, the controller may allow alteration of termination temperature and/or termination time. The controller may restrict adjustment of which components are allowed to operate in a defrost operation, pressures allowed in a defrost operation, etc.

In some implementations, the predetermined value for a predetermined cycle time may be based on a property of the heat pump, such as capacity. For example, a 5 ton heat pump may be associated with a predetermined heating operation cycle time of 45 minutes. When a heating operation cycle time is less than 45 minutes, the defrost operation of the 5 ton heat pump may be altered. In some implementations, a 2 ton heat pump may be associated with a predetermined heating operation cycle time of 50 minutes. When a heating operation cycle time is less than 50 minutes, the defrost operation of the 2 ton heat pump may be altered.

In some implementations, more than one property of a defrost operation may be adjusted. In some implementations, the termination time and the termination temperature may be adjusted. In some implementations, the same property and/or different properties may be adjusted for more than one defrost operation. For example, if a heat pump allows a primary and a secondary defrost operation, the termination temperature in the primary and the secondary defrost operation may be increased. In some implementations, the termination temperature in a primary defrost operation may be adjusted and a termination time may be adjusted in a second defrost operation.

In some implementations, a determined heating operation cycle time is compared to a second predetermined heating operation cycle time (e.g., the same and/or a different to the previously described predetermined heating operation cycle time), the determined heating operation cycle may be greater than the predetermined heating operation cycle time. A determination may be made to allow adjustment of a property of a defrost operation based on the comparison. Since the heating operation cycle time is longer (e.g., than previous heating operation cycles, than a default value, and/or other predetermined heating operation cycle times), a defrost cycle may be adjusted to allow a shorter defrost cycle (e.g., shorter termination time) and/or a lower termination temperature. Thus, since less ice accumulation appears to be present (e.g., since the length of the heating operation cycle is increasing which may indicate less defrost cycle are needed to deice), a shorter or lower temperature defrost cycle may reduce costs and/or increase user satisfaction (e.g., since the time period that cool air is blown into a location, due to operation of a cooling operation during a defrost operation may be reduced). For example, if the determined heating operation cycle time is greater than approximately 60 minutes for one or more heating operations, then the defrost operations may be altered to reduce one or more termination properties and/or the defrost operations may be allowed to return to a default and/or field technician provided setting.

In some implementations, at least a portion of the described systems and processes may be included in a default setting of a heat pump. The heat pump may determine whether to allow defrost operation(s) and/or adjust a property of a defrost operation based on the default setting. A user (e.g., who adjusts a thermostat and/or a field tech) may request alteration of the default settings. For example, alterations of a default setting of a heat pump may increase the initial termination temperature (e.g., based on a default setting and/or user adjusted setting) for a defrost operation, determine which default operation to allow, and/or determine the rate at which a termination property (e.g., time and/or temperature) is increased between successive adjustments in default properties of a defrost operation. An operation module of the heat pump may then be altered based on the requested alterations of default settings and the heat pump may operate based on the alteration.

In some implementations, the heat pump may include two defrost operations, such as a primary and a secondary defrost operation, similar to the described operations in U.S. patent application Ser. No. 13/690,645. The primary defrost operation may include allowing a cooling cycle of the heat pump. In some implementations, the primary defrost operation may include restricting operation of at least one of the fans of the heat pump. The secondary operation of the heat pump may include allowing fan(s) of the heat pump to operate at a low speed, where fan(s) include a low speed and at least one higher speed. The secondary defrost operation may be allowed if the determination is made to allow the secondary defrost operation of the heat pump and an amount of frost accumulation disposed proximate part(s) of the heat pump may be at least partially reduced. In some implementations, the heat pump may allow the primary defrost operation at a first predetermined termination property value, rather than at the maximum termination property value. Then as the heating operation cycle time is monitored, based on the heating operation cycle time the heat pump may alter the termination property value of the primary defrost operation. For example, if the heating operation cycle time is less than a first predetermined heating operation cycle time (e.g., 45 minutes), then the operation module may increase the termination property of the primary defrost operation. (e.g., by an incremental value, such as 10 degrees Fahrenheit and/or by 5 minutes). The operation module may or may not alter the secondary defrost operation. For example, if the secondary defrost operation is allowed, the heating operation cycle time may be compared to a third predetermined heating operation cycle time, which may or may not be the same as the first heating operation cycle time. If the heating operation cycle time is less than a third predetermined heating operation cycle time, then a property (e.g., time of fan operation) may be increased (e.g., to a maximum allowed time and/or by an incremental value, such as 5 minutes).

In some implementations, a temperature of a portion of the heat exchanger (e.g., coils) may be measured and/or monitored. The change in the temperature may be utilized to determine whether to allow an additional defrost operation, such as the described secondary defrost operation. For example, a change in temperature over time, a change in the ratio (e.g., slope) of the temperature to time, a change in temperature, and/or a temperature value may be monitored and/or compared to predetermined values. A determination of whether to allow a secondary defrost operation may be based at least partially on this comparison.

In some implementations, a determination of whether to allow one or more of the defrost operations may be based on various factors. For example, properties of a heat pump may be monitored and an ice event may be identified. A determination of whether to allow the secondary defrost operation may be based at least partially on the identified ice event.

In some implementations, an ice sensor may be utilized to determine if an ice event has occurred. U.S. patent application Ser. No. 13/690,561 to Uselton et al. entitled "Ice Sensor for a Heat Pump" and filed on Nov. 30, 2012 describes some ice sensors, and is incorporated by reference as if fully described herein. The ice sensor may identify ice events and defrost operations may be allowed and/or altered to reduce the frost accumulation.

In some implementations, properties of a fan may be monitored to determine ice events, which indicate ice events and/or frost accumulation on portions of the heat pump. U.S. patent application Ser. No. 13/690,463 to Qu et al. entitled "Defrost Control Using Fan Data" and filed on Nov. 30, 2012 describes fan monitoring to determine frost accumulation, and is incorporated by reference as if fully described herein. The heat pump may monitor properties of the fan to identify ice events and allow defrost operations and/or alterations thereof based at least partially on the identification of the ice events.

Although FIG. 1 describes an implementation of a heat pump, other implementations may be utilized as appropriate. For example, the heat pump may be disposed inside a building. In some implementations, the heat pump may include a metering device, such as an expansion valve.

Although a specific controller has been described in FIG. 1, the controller may be any appropriate computer or other programmable logic device. The controller may include a processor that executes instructions and manipulates data to perform operations of the controller. Processor may include a programmable logic device, a microprocessor, or any other appropriate device for manipulating information in a logical manner and memory may include any appropriate form(s) of volatile and/or nonvolatile memory, such as RAM and/or Flash memory.

The memory may include data, such as predetermined property values (e.g., temperature, moisture level, and/or pressure); predetermined properties of events such as frost accumulation, ice events, and/or other events to facilitate identification of the predetermined events; periods of time that operations should run (e.g., maximum operational time); and/or any other data useful to the operation of the heat pump and/or defrost operations (e.g., primary and/or secondary defrost operations).

In addition, various software may be stored on the memory. For example, instructions (e.g., operating systems and/or other types of software), an operation module, primary defrost module, and/or secondary defrost module may be stored on the memory. The operation module may perform one or more of the operations described in processes 200 and 300, such as operating the heat pump during normal operations (e.g., operations in which the system operates based at least partially on user requests for operation and/or during non-ice events). For example, the operation module may receive requests for operation from a user and operate the heat pump to satisfy the user request. The primary defrost operation may restrict operation of fan(s), energize reversing valves, allow cool cycles of the heat pump, restrict operation(s) of a secondary defrost operation, and/or allow other operations to at least partially reduce frost accumulation. The secondary defrost operation may allow fan operations at low speed; monitor properties to indicate when to initiate and/or end primary and/or secondary defrost operations; restrict and/or allow various operation(s) of the primary defrost operation, retrieve data such as predetermined values for properties; compare properties to predetermined property values; determine whether to initiate and/or end defrost operations based on monitored properties; identify ice events; adjust predetermined values; and/or allow other operations to at least partially reduce frost accumulation of at least a portion of the heat pump.

In some implementations, modules may be combined, such as into a single module or multiple modules. Operation modules and defrost modules may be distinct modules. In an implementation, operation modules and/or defrost modules may include various modules and/or sub-modules.

A communication interface may allow the controller to communicate with components of the heat pump, other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel, USB, and/or FireWire). Operations of the heat pump stored in the memory may be updated and/or altered through the communication via network protocols (e.g., remotely through a firmware update and/or by a device directly coupled to the controller).

The controller may include a presentation interface to present data to a user, such as though a monitor and speakers. The presentation interface may facilitate receipt of requests for operation from users.

A client (e.g., control panel in field or building) may allow a user to access the controller and/or instructions stored on the controller. The client may be a computer system such as a personal computer, a laptop, a personal digital assistant, a smart phone, or any computer system appropriate for communicating with the controller. For example, a technician may utilize a client, such as a tablet computer, to access the controller. As another example, a user may utilize a client, such as a smart phone, to access the controller and request operations.

Although FIG. 1 provides one example of controller that may be used with the disclosure, controller can be implemented through computers such as servers, as well as a server pool. For example, controller may include a general-purpose personal computer (PC) a Macintosh, a workstation, a UNIX-based computer, a server computer, or any other suitable device. In some implementations, a controller may include a programmable logic device. For example, the controller may be mounted to a wall of a location in which air conditioning may be provided. According to one implementation, controller may include a web server. Controller may be adapted to execute any operating system including UNIX, Linux, Windows, or any other suitable operating system. Controller may include software and/or hardware in any combination suitable to provide access to data and/or translate data to an appropriate compatible format.

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementations in one or more computer programs that are executable and/or interpretable on a programmable system, including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Although users have been described as a human, a user may be a person, a group of people, a person or persons interacting with one or more computers, and/or a computer system.

Various described patents and patent applications have been incorporated by reference. The described patents and patent applications are incorporated by reference to the extent that no conflict exists between the various described systems and/or processes and the described patents and patent applications. Any portion(s) of such described patents and patent applications that are in conflict with the various described systems and/or processes are not incorporated by reference.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a defrost operation" includes a combination of two or more defrost operations and reference to "a adjustment" includes different types and/or combinations of adjustments.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A method comprising:

initiating one or more operations of a heat pump, wherein the heat pump includes a heating operation and first and second defrost operations;

determining at least one heating operation cycle time associated with at least one heating operation of the heat pump;

determining whether to adjust a termination time of the first defrost operation based at least partially on one or more of the determined heating operation cycle times;

determining whether to adjust a termination temperature of the second defrost operation based at least partially on one or more of the determined heating operation cycle times; and initiating at least one of the first and second defrost operations;

wherein determining whether to adjust the termination time of the first defrost operation is further based at least partially on comparing a change in temperature over time to a predetermined change in temperature.

2. The method of claim 1 further comprising determining whether to adjust a termination temperature of the first defrost operation.

3. The method of claim 1 wherein the termination temperature of the second defrost or operation comprises a default termination temperature; and further comprising:

receiving a request for alteration of the termination temperature by a user; and altering the termination temperature based on the received request.

4. The method of claim 1 wherein initiating the at least one of the first and second defrost operations comprises allowing an unaltered defrost operation when a determination is made to not allow an adjustment of the termination time.

5. The method of claim 1 wherein initiating the at least one of the first and second defrost operations comprises allowing an altered defrost operation when a determination is made to allow an adjustment of the termination time.

6. The method of claim 1 wherein determining whether to adjust the termination temperature of the second defrost operation comprises:

comparing at least one of the determined heating operation cycle times to a predetermined cycle time; and adjusting the termination temperature based on the comparison.

7. The method of claim 1 wherein determining whether to adjust the termination time of the first defrost operation comprises:

comparing at least one of the determined heating operation cycle times to a predetermined cycle time; and adjusting the termination time when at least one of the determined heating operation cycle times is less than the predetermined cycle time.

8. A method comprising:

initiating one or more operations of a heat pump, wherein the heat pump includes a heating operation and first and second defrost operations;

determining at least one heating operation cycle time associated with at least one heating operation of the heat pump;

determining whether to adjust a termination time of the first defrost operation based at least partially on one or more of the determined heating operation cycle times;

determining whether to adjust a termination temperature of the second defrost operation based at least partially on one or more of the determined heating operation cycle times; and initiating at least one of the first and second defrost operations;

wherein determining whether to adjust the termination temperature of the second defrost operation comprises:

comparing at least one of the determined heating operation cycle times to a predetermined cycle time; and adjusting the termination temperature based on the comparison of the at least one of the determined heating cycle times and predetermined cycle time.

9. The method of claim 8 further comprising determining whether to adjust a termination temperature of the first defrost operation.

10. The method of claim 8 wherein the termination temperature of the second defrost operation comprises a default termination temperature, and the method further comprising:

receiving a request for alteration of the termination temperature by a user; and altering the termination temperature based on the received request.

11. The method of claim 8 wherein initiating the at least one defrost operation comprises allowing an unaltered defrost operation when a determination is made to not allow an adjustment of the termination time.

12. The method of claim 8 wherein initiating the at least one defrost operation comprises allowing an altered defrost operation when a determination is made to allow an adjustment of the termination time.

13. The method of claim 8 wherein determining whether to adjust the termination time of the first defrost operation comprises:

comparing at least one of the determined heating operation cycle times to a predetermined cycle time; and adjusting the termination time when at least one of the determined heating operation cycle times is less than the predetermined cycle time.

14. A method comprising:

initiating one or more operations of a heat pump, wherein the heat pump includes a heating operation and first and second defrost operations;

determining at least one heating operation cycle time associated with at least one heating operation of the heat pump;

determining whether to adjust a termination time of the first defrost operation based at least partially on one or more of the determined heating operation cycle times;

determining whether to adjust a termination temperature of the second defrost operation based at least partially on one or more of the determined heating operation cycle times; and initiating at least one of the first and second defrost operation;

wherein determining whether to adjust the termination time of the first defrost operation comprises:

comparing at least one of the determined heating operation cycle times to a predetermined cycle time; and adjusting the termination time when at least one of the determined heating operation cycle times is less than the predetermined cycle time.

15. The method of claim 14 further comprising determining whether to adjust a termination temperature of the first defrost operation.

16. The method of claim 14 wherein the termination temperature of the second defrost operation comprises a default termination temperature, and the method further comprising:

receiving a request for alteration of the termination temperature by a user; and altering the termination temperature based on the received request.

17. The method of claim 14 wherein initiating the at least one defrost operation comprises allowing an unaltered defrost operation when a determination is made to not allow an adjustment of the termination time.

18. The method of claim 14 wherein initiating the at least one defrost operation comprises allowing an altered defrost operation when a determination is made to allow an adjustment of the termination time.

* * * * *